US006743110B2

(12) United States Patent
Frazier

(10) Patent No.: US 6,743,110 B2
(45) Date of Patent: Jun. 1, 2004

(54) GOLF COURSE AND METHOD OF PLAY

(76) Inventor: Lex E. Frazier, P.O. Box 158, Coolidge, TX (US) 76686

( * ) Notice: Subject to any disclaimer, the term of this patent is extended or adjusted under 35 U.S.C. 154(b) by 0 days.

(21) Appl. No.: 10/256,792

(22) Filed: Sep. 27, 2002

(65) Prior Publication Data

US 2003/0032492 A1 Feb. 13, 2003

Related U.S. Application Data

(63) Continuation-in-part of application No. 09/559,990, filed on Apr. 26, 2000, now abandoned.

(51) Int. Cl.[7] ..... A63B 67/02
(52) U.S. Cl. ..... 473/169
(58) Field of Search ..... 473/168–170, 473/409

(56) References Cited

U.S. PATENT DOCUMENTS

| | | | | | |
|---|---|---|---|---|---|
| 3,526,405 | A | | 9/1970 | Morris | 273/181 |
| 3,877,704 | A | | 4/1975 | Bayley | 273/176 |
| 4,157,831 | A | * | 6/1979 | Renn | 473/169 |
| 4,171,134 | A | | 10/1979 | Reck | 273/181 |
| 4,171,812 | A | | 10/1979 | Marsin | 273/185 |
| 4,413,827 | A | * | 11/1983 | Aberg | 473/169 |
| 4,934,704 | A | | 6/1990 | Mazer | 273/176 |
| 5,076,586 | A | * | 12/1991 | Taniguchi et al. | 473/169 |
| 5,203,566 | A | * | 4/1993 | Ricigliano | 473/169 |
| 5,213,330 | A | * | 5/1993 | Benson | 473/169 |
| 5,265,875 | A | * | 11/1993 | Fitzgerald | 473/169 |
| 5,401,027 | A | | 3/1995 | Surbeck | 273/181 |
| 5,490,671 | A | | 2/1996 | Picard | 273/176 |
| 5,642,886 | A | | 7/1997 | Yancey, Jr. | 273/408 |
| 5,984,793 | A | | 11/1999 | Palombi | 473/195 |
| 6,036,606 | A | * | 3/2000 | Dumas | 473/169 |
| 6,113,502 | A | * | 9/2000 | Wilk | 473/169 |

OTHER PUBLICATIONS

Klein, "Architects' challenge: Tame those tigers", Mar. 1998, Golfweek.*
Shackelford, "By Design: alister MacKenzie", Apr. 1998, GOLF Magazine.*
Klein, "Architects' challenge: Tame those tigers", Mar. 1998, Golfweek.
Shackelford, "By Design: alister MacKenzie", Apr. 1998, GOLF Magazine.

* cited by examiner

*Primary Examiner*—Mark S. Graham
(74) *Attorney, Agent, or Firm*—Dennis T. Griggs

(57) ABSTRACT

A golf course is laid out for play in a front round and a back round, with each round being played on a sequence of eleven holes spaced apart along a course that traverses natural rough environs. The holes are integrated into the existing natural rough environs thereby forming playable green areas adjoining out-of-play rough areas. Each hole includes a green located within an out-of-play boundary line, and the distance between the approximate center of the green and its out-of-play boundary line is fractionally proportional to the spacing distance that separates the green in play from the preceding green. All play is single stroke from green-to-green (hole-to-hole). The spacing distance from one green playing area to the next is limited to a predetermined distance that is calculated to allow it to be spanned in a single stroke by a beginning player.

17 Claims, 6 Drawing Sheets

GOLF COURSE AND METHOD OF PLAY

CROSS-REFERENCE TO RELATED APPLICATIONS

This application claims priority from U.S. application Ser. No. 09/559,990 filed Apr. 26, 2000, abandoned.

STATEMENT REGARDING FEDERALLY SPONSORED RESEARCH OR DEVELOPMENT

Not applicable.

BACKGROUND OF THE INVENTION

This invention relates generally to the game of golf, and in particular to improvements in course layout and method of play that satisfy the needs of beginning and intermediate players.

Golf is quite often referred to as the fastest growing sport in the world today. It seems more and more people of all ages are taking up the game. More and more golf courses are being built and golf in general is looked on as big business. With all this going for the sport one would be somewhat surprised to learn that a continuing problem confronting the game's two main keepers, the USGA and the PGA, is how to grow the sport, to retain and encourage newcomers.

The truth is that for every ten people who take up golf eight are no longer playing a year later. For each new course that opens, two established courses are sold for pennies on the dollar, and few equipment manufacturers have been profitable in recent years. Courses are built to help sell real estate, and once the real estate is sold then the course has to find a way to survive on it's own. Equipment manufactures spend more on advertising than they make in an attempt to win a share of the market. They constantly change their product line in hopes that their new promises to the golfer will prove to be the one that will make their company stand above the rest. Although the reasons for these problems are diverse, there is a solution that would benefit anyone remotely involved with the sport: encourage new players coming into the game to continue playing until they become proficient and competitive.

In order to accomplish this seemingly impossible task one must first understand why the problem exists. Although people take up the sport for many different reasons, they seem to all leave for the same reason. Courses are built today to resemble courses that are used in tour events where the greatest players in the world compete. They are long and difficult, complete with water hazards, multiple sand traps, thick rough, narrow fairways, and severely fast and undulating greens. These are great characteristics for tour players and advanced golfers but for those just learning the game and having to do it in an environment where they are rushed and experience very little success, it's simply more than they bargained for. So they quit the game.

The answer lies in two areas: better learning facilities and more favorable learning conditions. The present invention, referred to as "Golf 22," is more than just another game, it's an exiting new golfing experience that offers something to amateur golfers of all playing levels. For the beginner, it offers a learning environment that's friendly, an environment where players can experience success and a desire to continue to learn and play the game of golf without the frustrations they would endure on a conventional course. For the more experienced player, it offers a great practice environment for the area of golf that's most important—the short game. Not many practice areas are available to the advanced amateur golfer who wishes to work on his short game in a competitive way.

BRIEF SUMMARY OF THE INVENTION

The layout of conventional golf courses that may be used for regulation play is constantly being improved, within the playing rules and regulations established by the USGA. In the present invention, an improved golf course is designed to accommodate the needs of beginners as well as more advanced players in a unique layout allowing for many of the variety of strokes encountered on a conventional golf course, but in a compact arrangement that requires less acreage for regulation play and on which twenty-two holes can be played at par in about two hours, thirty minutes.

These advantages are provided, according to the present invention, by a golf course that is laid out in a total of eleven holes integrated within the existing natural rough environs of the site. The holes are arranged for play in a front round of eleven holes and a back round returning in a clockwise pattern over the same eleven holes, with each round being played over a sequence of greens spaced apart along the course. Each green is separated from the rough by an out-of-play (OP) boundary line, and the distance between the center of each green and the out-of-play boundary line is proportional to a predetermined fraction of the spacing distance that separates the center of the green of the hole at play from the center of the preceding green in the sequence. There are no conventional fairways separating the greens. Instead, the greens are integrated within the existing natural rough environs of the site. The roughs are maintained only for aesthetics, and not for play purposes.

Golf balls landing inside the OP boundary on the green are playable, and everything hit outside the OP boundary line is out of play, incurring a penalty. There are no hazards within the green areas, and the rough area lying between greens is not maintained as a playable zone. Instead, all play is from green-to-green (hole-to-hole). The spacing from one green to the next between some holes is limited to a predetermined driving distance that is calculated to allow it to be spanned in a single stroke by a beginner. The spacing distance between other holes is calculated to allow the green to be hit in a single stroke by more experienced players.

A complete round (22 holes) is designed for single stroke play from hole-to-hole. Each hole comprises a green enclosed within an out-of-play (OP) line, a cup, a flag pole with flag and a set of tee boxes. The green area is used for teeing purposes by removing the flag pole when playing the hole. After driving the ball from a selected tee box located on the green, the flag is replaced in the upright position. According to one embodiment of the invention, the ball is hit to the next hole directly over the green where play was just finished. The tee boxes are advantageously positioned on or about the green for making tee shots to the next hole, either to the rear of the cup, on either side of the cup or forward of the cup, thus providing a longer driving distance for more experienced players and a shorter driving distance for beginners. When the tee is placed to the rear of the cup for more advanced players, the green itself is used to make up the net driving distance (from tee to next green) thereby minimizing the total course acreage required for par play. When the tee is placed forward of the cup, the net driving distance is reduced, thus accommodating the needs of beginning players. The tee is placed to the side of the cup to accommodate the needs of average or intermediate players.

BRIEF DESCRIPTION OF THE DRAWING

The accompanying drawing is incorporated into and forms a part of the specification to illustrate the preferred embodiments of the present invention. Various advantages and features of the invention will be understood from the following detailed description taken with reference to the attached drawing figures in which.

DETAILED DESCRIPTION OF THE INVENTION

Figure 1:
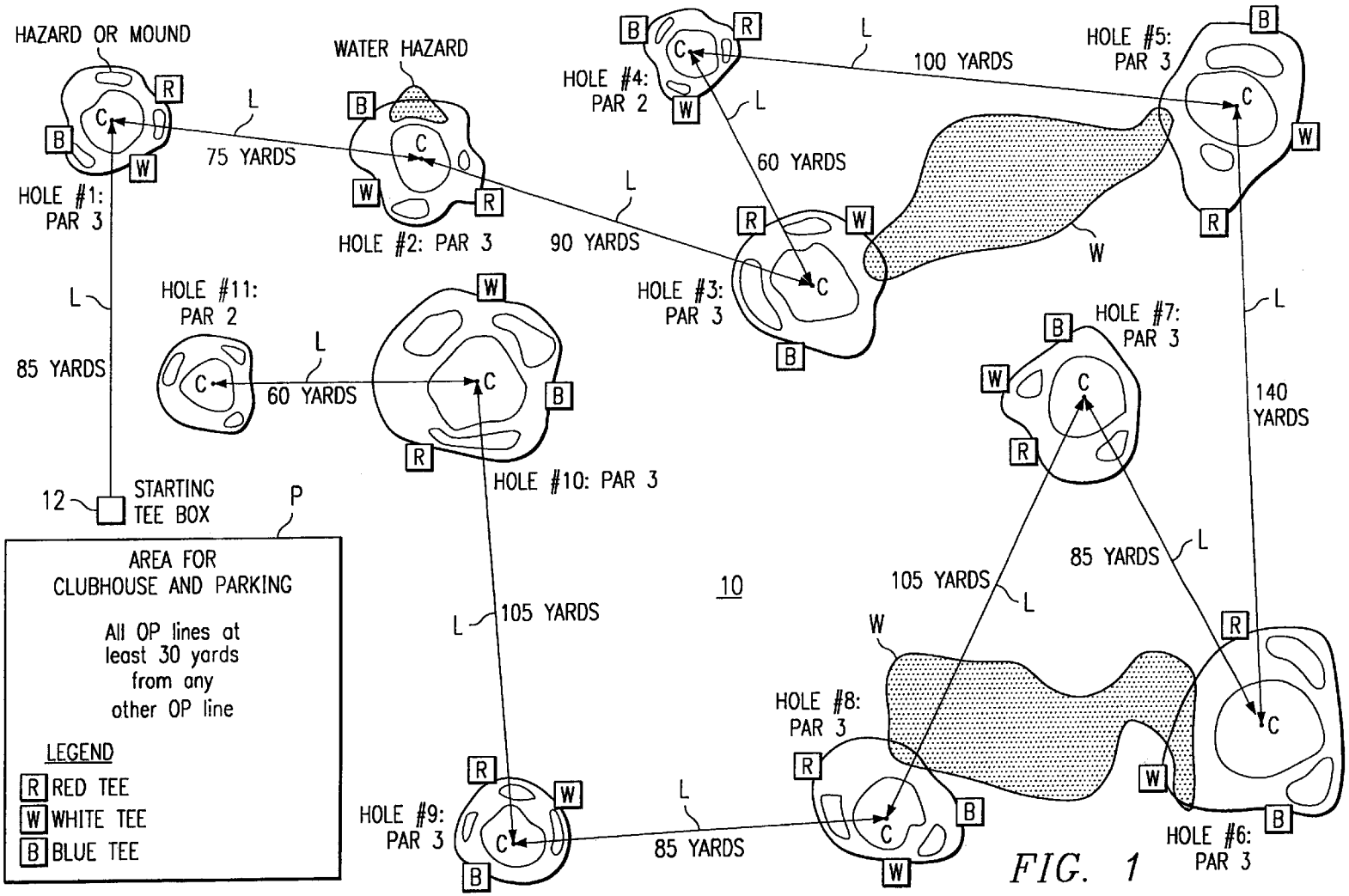
FIG. 1 is a simplified topographical plat or aerial plan view of a golf course laid out according to one embodiment of the present invention.

Preferred embodiments of the invention will now be described with reference to various examples of how the invention can best be made and used. Like reference numerals are used throughout the description and several views of the drawing to indicate like or corresponding parts.

Figure 2:
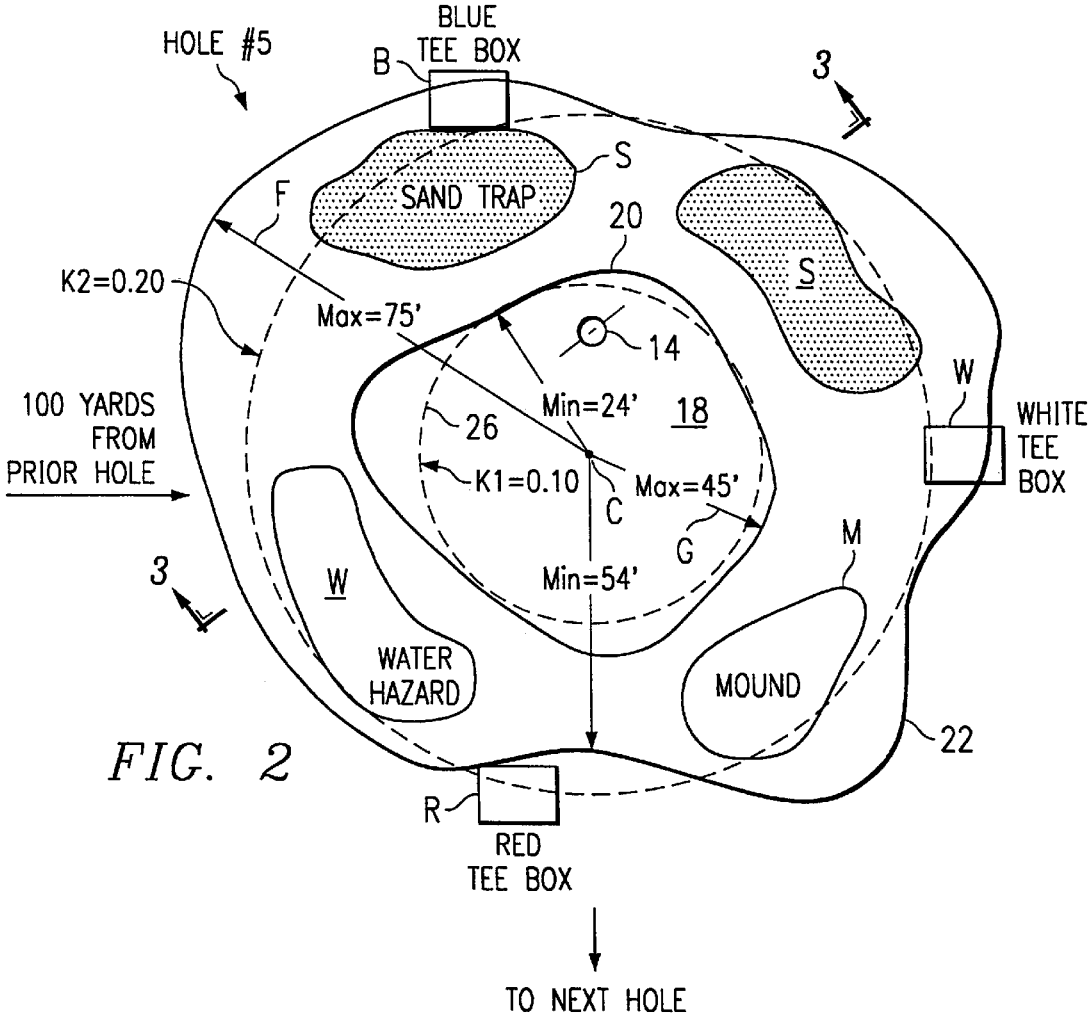
FIG. 2 is a top plan view of a typical green laid out on the golf course shown in FIG. 1, showing two different OP line arrangements.

Referring now to FIG. 1 and FIG. 2, the golf course 10 according to a first embodiment of the present invention includes eleven holes extending over about 25 acres of land, as compared with about 60 acres or more of land required for a conventional nine-hole golf course. A round of eleven holes, numbered Hole #1 through Hole #11, extends in a partially convoluted course pattern over a walking distance of from a minimum of about 1,000 yards to a maximum of about 1,265 yards commencing from a starting tee box 12 adjacent a clubhouse and parking area P and advancing sequentially from hole-to-hole along a circuitous round and terminating at Hole #11 near the starting tee box. A cup 14 and a set of tee boxes are located on each hole. Each round includes nine (9) par three holes and two (2) par 2 holes, for a total of twenty-two holes suitable for regulation play.

Figure 5:
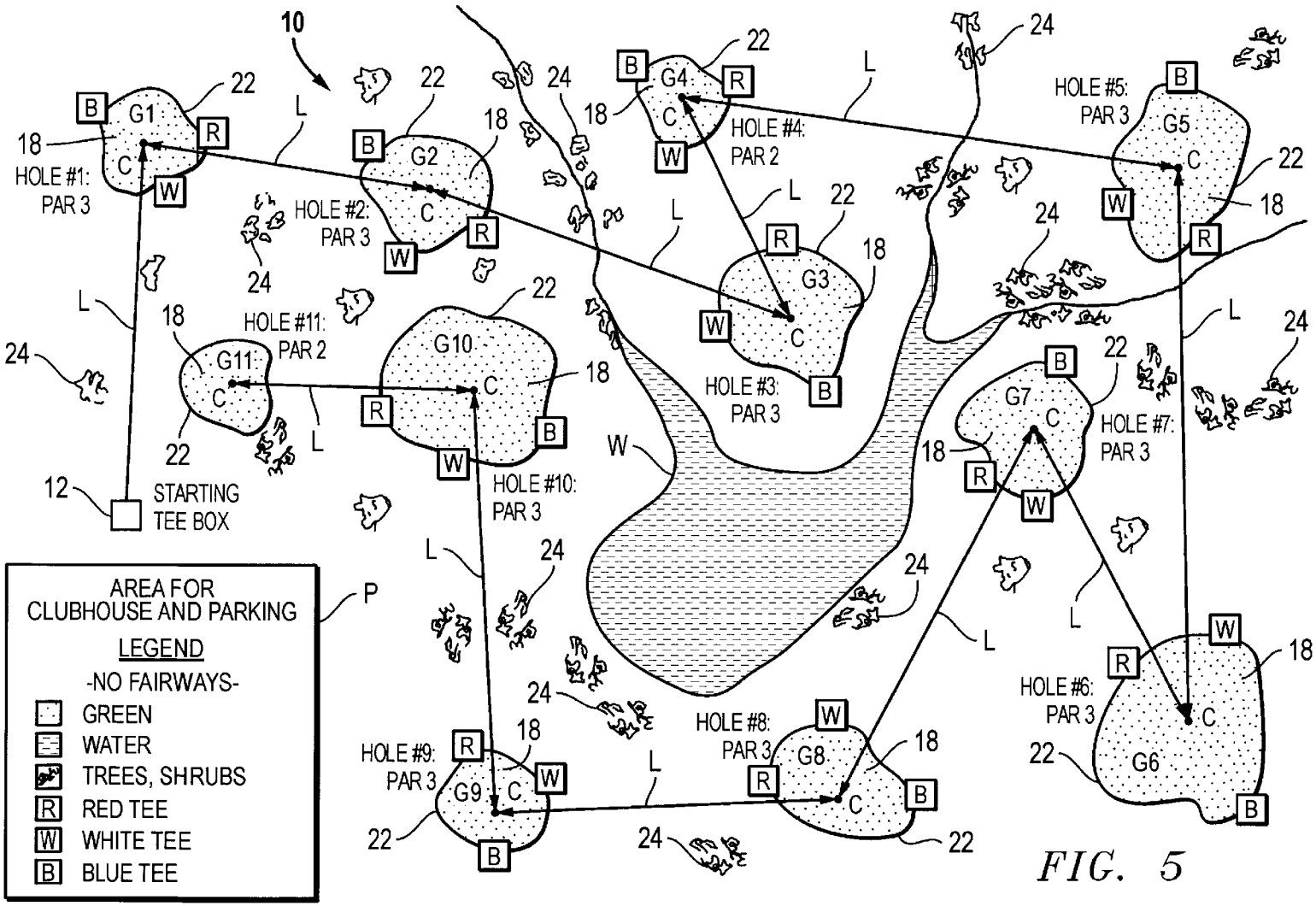
FIG. 5 is a simplified topographical plat or aerial plan view of a golf course integrated into natural environs according to another embodiment of the present invention.

The holes are integrated into the existing rough environs 24 as shown in FIG. 5. Preferably, the holes are spaced apart by a distance L that can be spanned in a single stroke, and the game is played in single strokes from hole-to-hole. Because the course is partially convoluted, the last Hole #11 of the round is located near the starting Hole #1, and play advances from hole-to-hole in clockwise fashion around the course. In the preferred embodiment, conventional fairways are not provided. The integrated rough areas are maintained only for aesthetics, and not for teeing or chipping purposes. Optionally, the course 10 may include one or more ponds or lakes W.

Referring now to FIG. 2, FIG. 3, FIG. 6 and FIG. 7, using Hole #5 as an example, all holes have the following in common: a regulation cup 14, or optionally an oversized 5 inch (inside diameter) cup, with a removable flag pole 16; a playing green area 18 in which the cup is embedded; a grass cut fringe line that delineates the out-of-play (OP) boundary line 22 of the hole; and the rough area 24 between the out of play boundary line of one hole and the out of play boundary line of the next hole in sequence that forms a part of the existing natural rough.

Figure 6:
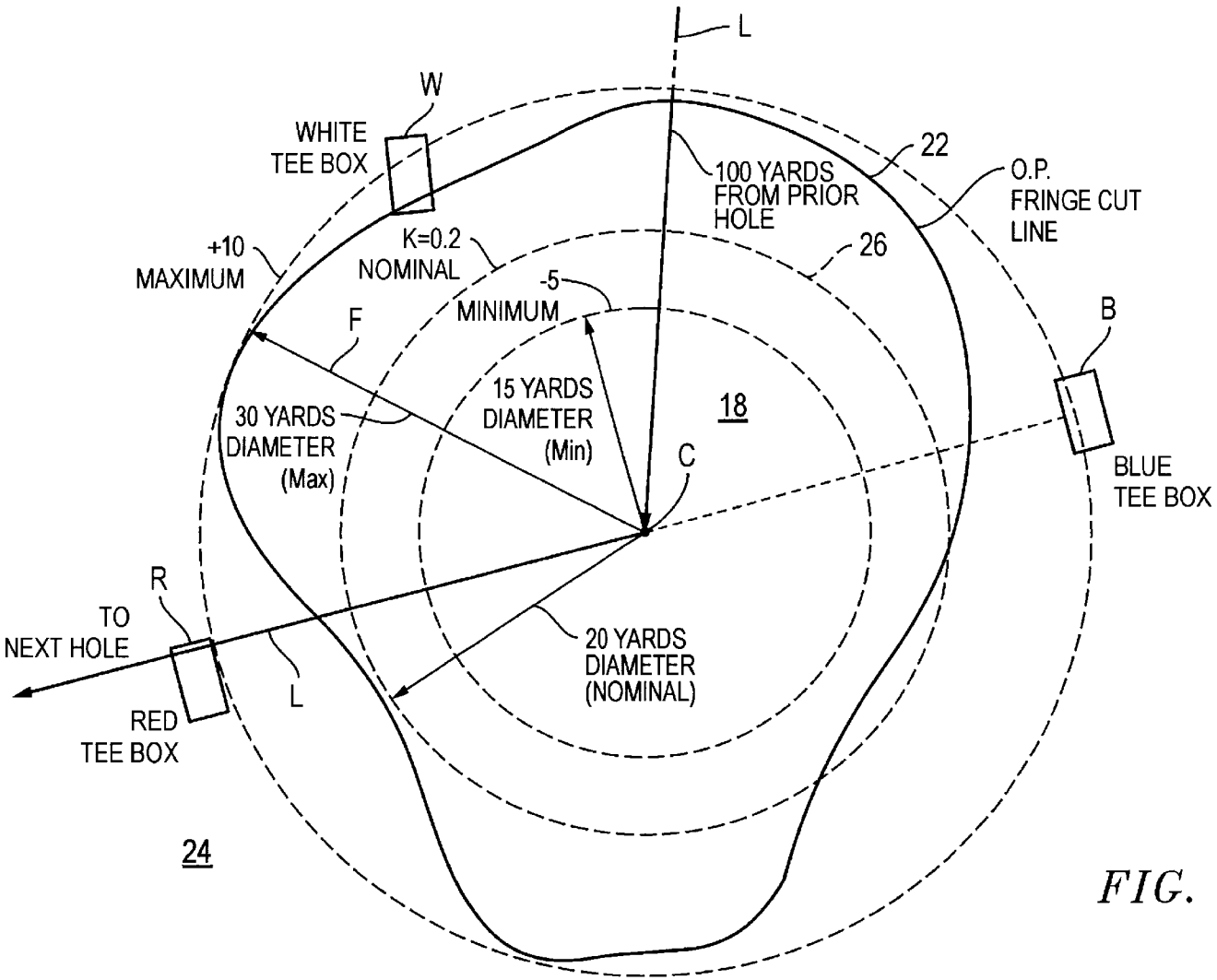
FIG. 6 is a top plan view of a typical green laid out on the golf course shown in FIG. 5.

The distances between adjacent holes and the size of the OP boundary lines are determined by the following rules: The spacing distances L between adjacent holes in sequence are measured from the center of the green of the previous hole to center of the green of the next hole in playing sequence. As used herein, "hole-to-hole spacing distance" is defined as the spacing distance L from the approximate center of the green playing area of a selected hole in the playing sequence to the approximate center of the green playing area of the immediately preceding hole in the playing sequence. The approximate center C of the playing green area 18 is located at a single stroke spacing distance L, for example 100 yards from the preceding playing green center, as shown in FIG. 6. For purposes of the present invention, the approximate center of the green playing area is defined as being coincident with the center or origin point C of an imaginary circle 26 that is substantially coincident with the green playing area. As used herein, "hole-to-hole spacing distance" refers to the straight line distance L between the approximate centers of any two adjacent greens within the playing round sequence.

Distances are rounded to the nearest yard. All par 2 holes are 65 yards ±5 yards in length. Two of the par 3 holes are 135 yards minimum, ±5 yards and 150 yards maximum, ±5 yards. Two of the par 3 holes are 80 yards, ±5 yards. Two of the par 3 holes are 105 yards, ±5 yards. Three of the par 3 holes are 95 yards minimum, ±5 yards, and 125 yards maximum, ±5 yards.

Figure 3:
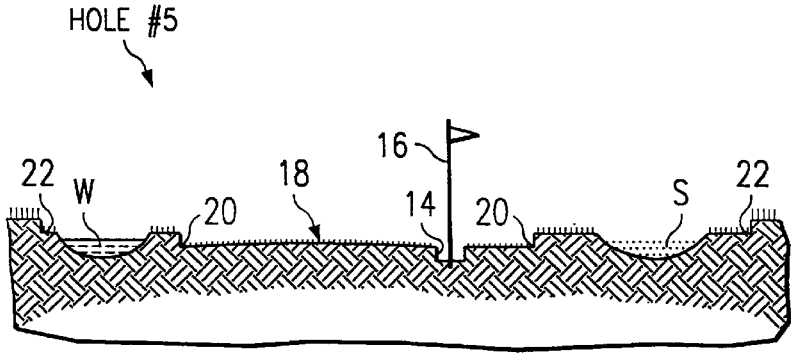
FIG. 3 is a side sectional view, taken along the line 3—3 in FIG. 2 that illustrates the formation of an out-of-play boundary line by differential height grass cut fringe landscaping.
Figure 7:
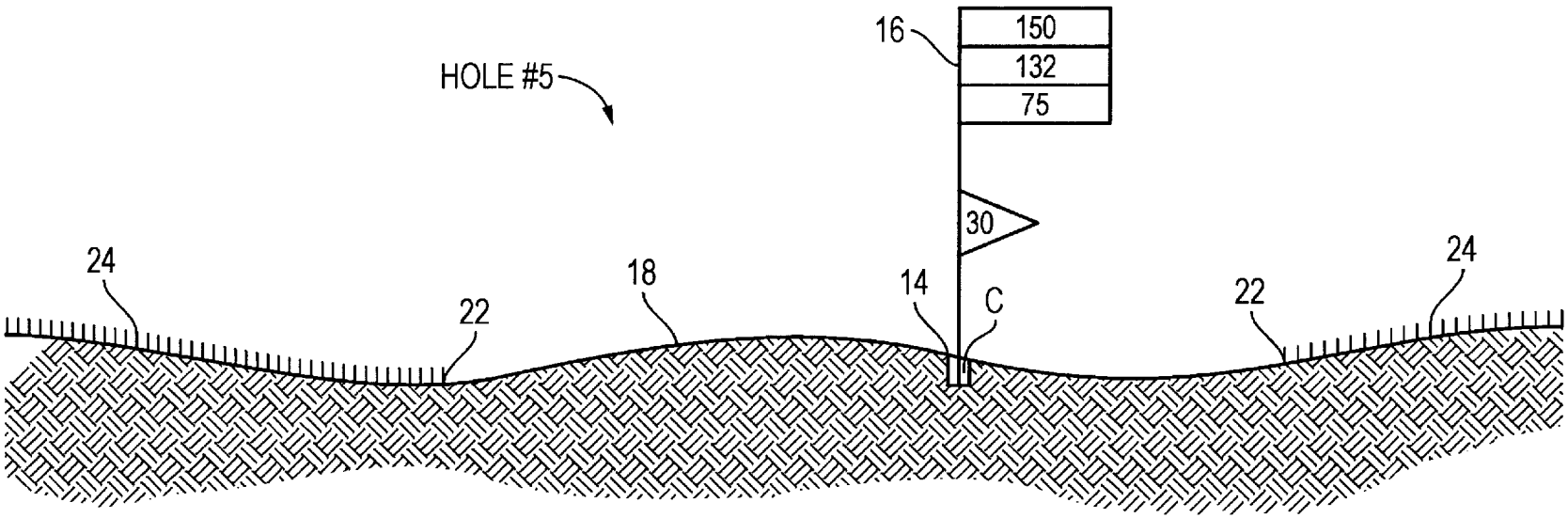
FIG. 7 is a side sectional view, taken along the line 7—7 in FIG. 5 that illustrates the formation of an out-of-play boundary line by differential height grass cut fringe landscaping.

Each green is separated from the rough by an out-of-play (OP) boundary line. According to an important rule of the game of Golf-22, a ball landing in the rough area outside of the OP boundary line is out of play, and draws a penalty. In that situation, the player must move the ball from the rough and place it inside the OP line on the green before resuming play. Preferably, the boundary lines (OP lines) between the green and the rough are established by differential height finger cut grass boundary fringe lines 22 as shown in FIG. 3 and FIG. 7. The minimum and maximum range limits of the OP boundary line are determined as follows:

The distance F from the center C of the green to the out of play (OP) boundary line 22 is the spacing distance L between the center of the green in play to the center of the preceding green multiplied by a predetermined scaling fraction K. Preferably, for large greens, the scaling fraction K=K2=0.20, and the limits are +10 yards maximum, −5 yards minimum. In this example, if the green in play is 100 yards from the preceding green, the OP boundary line 22 would meander or vary from 15 to 30 yards relative to the center point C. That is, the OP line winds and turns along a curved path that ranges or varies in its spacing distance not more than 30 yards and not less than 15 yards from the approximate center of the green playing area.

The approximate center C of the green may be established or located by visual survey and inspection for each green. Optionally, the center may be determined more precisely by the origin of an imaginary circle 26 that is substantially coincident with the green playing area, as shown in FIG. 2 and FIG. 6. As used herein, "substantially coincident" means that all or nearly all of the area enclosed by the imaginary circle overlaps the green playing area. Referring to FIG. 2, all of the area enclosed by the small diameter circle 26 (K1=0.10) is coincident with the green playing area 18. For the large diameter circle (K2=0.20), almost all of the enclosed area is coincident with the green playing area 18. In either case, the nominal spacing of the OP line from to the approximate center of the green playing area is proportional to a predetermined fraction K times the hole-to-hole spacing distance L. For a hole-to-hole spacing distance of 100 yards and scaling fraction K=0.2, the diameter of the imaginary circle 26 (the nominal diameter of the OP line) is 20 yards. The green playing area boundary established by the OP line varies or ranges within predetermined plus or minus limits relative to the imaginary circle and the approximate center C.

By way of further example for a smaller green playing area, the distance G between the center C of the green playing area 18 and its OP boundary line 20 varies in a range of about K1 times the distance L between the center of the green on the present hole to the center of the green on the preceding hole, within the limits +5 yards maximum, −2 yards minimum. In this example, the scaling fraction K=K1=0.10. If the center of the preceding green is 100 yards from the center of the present green, the out-of-play boundary line would meander or range from a minimum of 8 yards to a maximum of 15 yards relative to the center C of the green playing area 18.

As a safety precaution, each OP boundary line is spaced a minimum of 30 yards from any other OP line and a minimum of 30 yards from an imaginary line L joining or bisecting the centers of any two greens. It will be understood that the size (nominal diameter and range limits) of the OP line can be selected for each hole as desired by adjusting the scaling fraction K and ranging limits to accommodate safety spacing considerations as well as degree of playing difficulty. According to an important feature of the present invention, the playing green area surrounded by the out-of-play line for each hole is sized proportionally according to the hole-to-hole spacing distance, making the size of the green playing area for each hole commensurate with the single stroke driving distance to the hole. That is, the green playing area enclosed by the OP line is relatively large for long distance holes and relatively small for short distance holes, as indicated by the large area OP line 22 and the small area OP line 20 in FIG. 2.

The cup 14 is located anywhere on the green 18 at least 2 yards inside the OP boundary line.

In the exemplary embodiment of FIG. 5, three tee box locations are provided for each hole: the Red tee box R is located the shortest distance to the center of next green; the White tee box W is located at the median distance to the center of the next green; and the Blue tee box B is located the longest distance to the center C of the next green. Preferably, each tee box consists of a synthetic turf mat located within about 5 yards of the OP line 22, either fully inside the OP line, extending partially across the OP line or lying slightly outside the OP line. The Blue tee box may be placed to the rear of the cup outside of the OP line for more advanced players, as shown in FIG. 6. In this arrangement, the green itself is used to make up the net single stroke driving distance from tee to next green.

Optionally, for intermediate and advanced play, at least two sand traps S and at least one mound M per hole may be provided, as shown in FIG. 2. A tee box inside or crossing the OP line is treated as a mound. Each sand trap S is located at least 1 yard from the OP line. A sand trap may be combined with a tee box, but must be located as described above. In holes designed for beginning players, these features are omitted.

The golf game of the present invention can be played on the golf course 10 in two ways: Total Points; and, Stroke Play. For Total Point play, hole-in-one shots and green shots are counted only for the initial placement, and points are allocated as follows:

Hole-in-one=50 points
Placement on Green=10 points
Each stroke under par=+10 points
Each stroke over par=−10 points For Stroke Play, par for 11 holes is 31 strokes, par for 22 holes is 62 strokes, and strokes are allocated as follows:

Par=0 strokes
Each stroke under par=−1 stroke
Each stroke over par=+1 stroke

If a tee shot lands out of play anywhere on the course (e.g., in the rough or in a hazard), the player must take a penalty stroke, move the ball in a straight line toward the cup 14 from where the ball lies or was last seen. The player must take a drop anywhere on this line no more than one club length inside the OP line 22.

Figure 4:
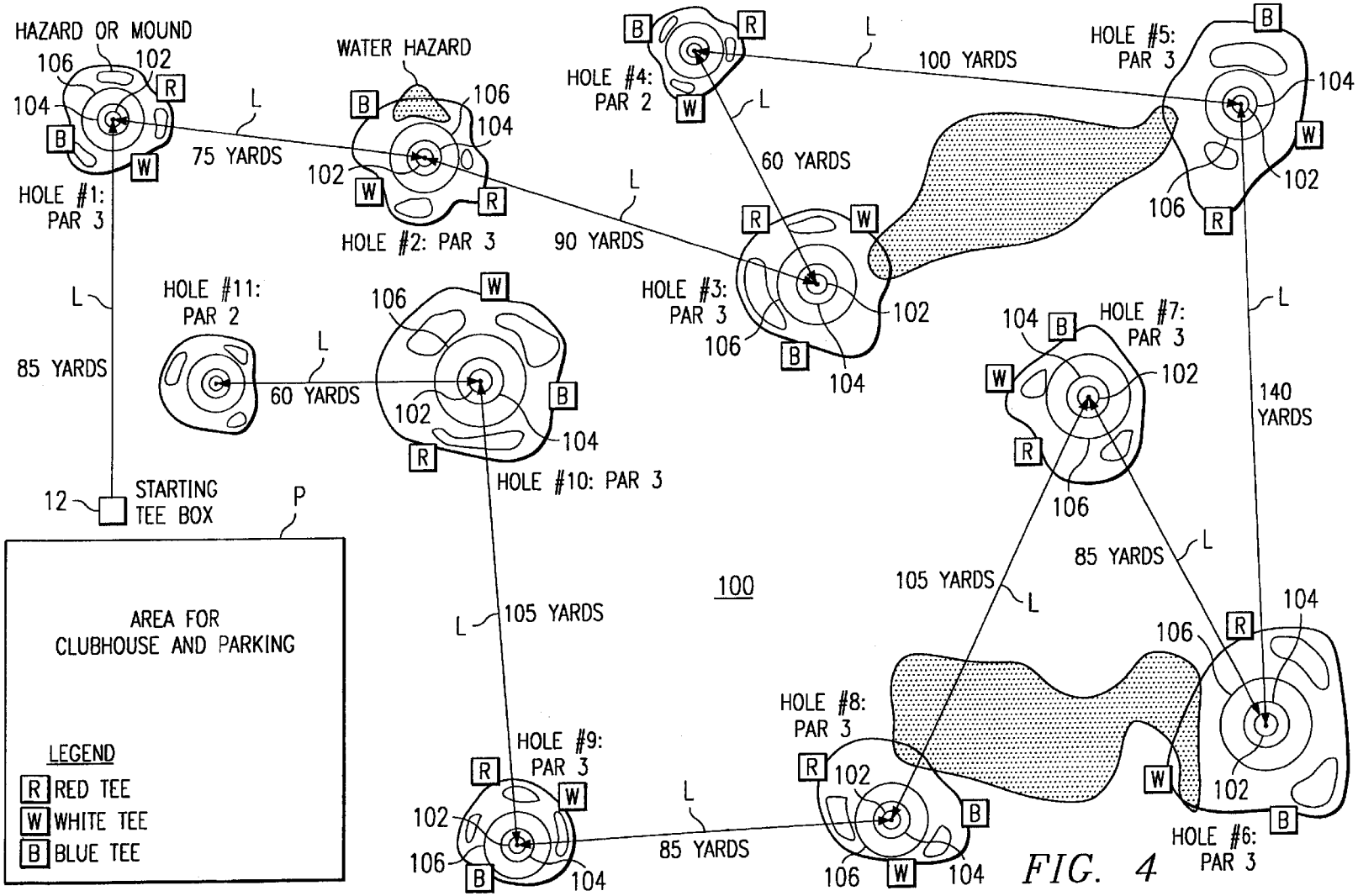
FIG. 4 is a simplified topographic plat or aerial plan view of a golf course laid out according to an alternative embodiment of the invention that is suitable for casual play, either outdoors or by computer simulation.

Referring now to FIG. 4, a golf course 100 constructed according to an alternative embodiment of the invention is disclosed. This alternative embodiment is suitable for play out-of-doors or simulated on a computer, and is substantially identical to the course layout shown in FIG. 1, except for the inclusion of three circular rings 102, 104 and 106 that are concentrically disposed about the cup 14. Points are allocated according to the following rules:

Initial placement of the ball in the cup corresponding with a hole-in-one, 50 points. Initial placement within the first ring 102 nearest to the cup, 35 points. Initial placement within the second or middle ring 104, 25 points. Initial placement of the ball within the outermost ring 106, 15 points. Par, 0 points. Each stroke under par, 10 points. Each stroke over par, minus 10 points.

In order to maintain a high level of game quality, a system of course rating is provided to allow development of a handicap system based on golfer performance over different courses. For example, a course rating system has been established on distance, with a higher rating point total signifying greater difficulty in play:

| Hole | Nominal Yards | Rating Points |
|---|---|---|
| Par 2 | 65 | 0 |
| Par 3 @ 75 yards | 75 | 0 |
| Par 3 @ 120 yards | 120 | 0 |
| Par 3 @ 130–150 yards | 130 | 2 |
| | 135 | 4 |
| | 140 | 6 |
| | 145 | 8 |
| | 150 | 10 |
| Par 3 @ 80–120 yards | 80 | 2 |
| | 90 | 4 |
| | 100 | 6 |
| | 110 | 8 |
| | 120 | 10 |

Although the invention has been described with reference to certain exemplary arrangements, it is to be understood that these examples are to be treated as preferred embodiments of the invention. Various changes, substitutions and modifications can be realized without departing from the spirit and scope of the invention as defined by the appended claims.

I claim:

1. A golf course laid out for play in rounds of one or more, each round including a sequence of holes spaced apart along the course and each hole including a green playing area bounded by an out-of-play boundary line, characterized in that the out-of-play boundary line follows a meandering path around the green playing area, the spacing distance of the out-of-play boundary line from the approximate center of the green playing area being equal to a predetermined fraction in the range of from about 0.10 to about 0.20 of the spacing distance from the approximate center of the green playing area of a selected hole in the playing sequence to the approximate center of the green playing area of the immediately preceding hole in the playing sequence.

2. A golf course as set forth in claim 1, wherein the hole-to-hole spacing distance is about 100 yards and the out-of-play boundary line meanders in a range of about +10 yards maximum to about −5 yards minimum.

3. A golf course as set forth in claim 1, wherein the hole-to-hole spacing distance is about 100 yards and the out-of-play boundary line meanders in a range of about +5yards maximum to about −2 yards minimum.

4. A golf course as set forth in claim 1, wherein the holes are integrated into existing natural rough environs of a site thereby forming playable green areas surrounded by out-of-play rough areas.

5. A golf course as set forth in claim 4, wherein the out-of-play boundary line comprises a differential height grass cut fringe line disposed at the interface between the playable green area and the out-of-play rough area.

6. A golf course as set forth in claim 1, wherein a cup is located on each green at least two yards inside of the out of play boundary line.

7. A golf course as set forth in claim 1, wherein each round comprises eleven holes.

8. A golf course as set forth in claim 1, wherein each round includes nine par three holes and two par two holes.

9. A golf course as set forth in claim 8, wherein the spacing distance separating each par two hole from a preceding hole is 65 yards ±5 yards.

10. A golf course as set forth in claim 8, wherein the spacing distance separating one or more of the par three holes from a preceding hole is a minimum of 135 yards ±5 yards to a maximum of 150 yards ±5 yards.

11. A golf course as set forth in claim 8, wherein the spacing distance separating one or more of the par three holes from a preceding hole is 80 yards +5 yards.

12. A golf course as set forth in claim 8, wherein the spacing distance separating one or more of the par three holes from a preceding hole is 105 yards ±5 yards.

13. A golf courseas set forth in claim 8, wherein the spacing distance separating one or more of the par three holes from a preceding hole is a minimum of 95 yards ±5 yards and a maximum of 120 yards ±5 yards.

14. A golf course as set forth in claim 1, including a cup embedded in each playing green area, wherein the cup is a metal or plastic cup having a cylindrical sidewall and an oversized flag pole is disposed upright in the cup, and the oversized flag pole is removable from the cup for measuring the lie of a golf ball inside the playing green area for scoring purposes.

15. A golf course laid out for play in rounds of one or more, each round including a sequence of holes spaced apart along the course and each hole including a green playing area, each green playing area being disposed within an out-of-play boundary line, characterized in that the distance between the approximate center of the green playing area and the surrounding out-of-play boundary line of a selected hole in the sequence is equal to a predetermined fraction in the range of from about 0.10 to about 0.20 of the hole-to-hole spacing distance between the center of the selected hole and the center of the preceding hole in the sequence, whereby the size of the playing green area for each hole is commensurate with the driving distance to the hole.

16. A golf course laid out for play in rounds of one or more traversing a site that includes rough environs, each round including a sequence of holes spaced apart along the course wherein the holes are integrated into the rough environs thereby forming playable green areas adjoining out-of-play rough areas, characterized in that each playing green area is disposed within an out-of-play boundary line separating playable green area from out-of-play rough area, wherein the hole-to-hole spacing between adjacent holes in the sequence is limited to a predetermined stroke distance and the area of playing green enclosed by the out-of-play boundary line is equal to a predetermined fraction in the range of from about 0.10 to about 0.20 of the stroke distance to allow the playing green area of each hole to be scored in a single stroke from the immediately preceding hole in the sequence.

17. A golf course as set forth in claim 16, comprising tee boxes disposed on or about the playing green area of each hole, to the rear of the cup, on either side of the cup or forward of the cup, thus providing a longer driving distance for more experienced players and a shorter driving distance for beginners.

* * * * *